United States Patent [19]

Zumbiel

[11] 4,380,911

[45] Apr. 26, 1983

[54] REFRIGERATION CONTROL APPARATUS

[76] Inventor: William A. Zumbiel, 85 Dudley Rd., Ft. Mitchell, Ky. 41017

[21] Appl. No.: 290,364

[22] Filed: Aug. 5, 1981

[51] Int. Cl.[3] ..... F25B 49/00

[52] U.S. Cl. ..... 62/228; 138/76

[58] Field of Search ..... 62/226, 228 D; 73/706, 73/714; 22/207; 138/26, 27

[56] References Cited

U.S. PATENT DOCUMENTS

| | | | |
|---|---|---|---|
| 701,754 | 6/1902 | Moran . | |
| 1,805,700 | 5/1931 | King | 62/226 X |
| 2,121,936 | 6/1938 | Thomas . | |
| 2,518,827 | 8/1950 | Smith | 138/27 |
| 2,929,399 | 3/1960 | Magowan . | |
| 3,095,589 | 4/1963 | Sands . | |
| 3,252,295 | 5/1966 | Leisher, Jr. | 62/226 X |
| 3,365,906 | 1/1968 | Zadig | 62/226 |
| 3,498,075 | 3/1970 | Zumbiel | 62/226 X |
| 3,561,471 | 2/1971 | Sands . | |
| 3,861,414 | 1/1975 | Peterson . | |
| 4,030,520 | 6/1977 | Sands . | |

*Primary Examiner*—William E. Tapolcai

*Attorney, Agent, or Firm*—Wood, Herron & Evans

[57] ABSTRACT

A refrigeration system including a pressure actuated switch for controlling the refrigeration compressor. The actuator of the switch is connected directly to the refrigerant line by a small capillary tube so that changes in refrigerant pressure effect changes in the position of the switch. Positioned between the pressure actuated switch and the refrigerant line is a bi-directional check valve which permits refrigerant pressure changes to be transmitted through the capillary line to the pressure actuated switch, but which functions to seal off the refrigerant line in the event of a break in the capillary tube.

6 Claims, 3 Drawing Figures

REFRIGERATION CONTROL APPARATUS

BACKGROUND OF THE INVENTION

1. Field of the Invention

The present invention relates to refrigeration cooling systems and, more particularly, to a control unit for use in combination with refrigeration cooling systems for controlling the refrigeration compressor in response to pressure changes in the refrigerant flow in the system.

2. Description of the Prior Art

The majority of all commercial refrigeration or air conditioning systems operate upon the principal of compressing a refrigerant in a compressor, passing the compressed refrigerant through a condenser to remove heat from the compressed refrigerant and then passing the cooled and compressed refrigerant through an expansion valve and evaporator back to the compressor. In passing through the evaporator, the refrigerant picks up heat from the surrounding atmosphere so as to cool that atmosphere. Refrigerant flow is generally controlled by controlling operation of the compressor; in other words, by turning the compressor on and off depending upon the temperature of the area to be cooled.

To control actuation of the compressor, most larger refrigeration systems utilize a pressure actuated switch. The bellows or actuator of this switch is connected directly to the refrigerant line by a small capillary tube so that changes in pressure (and temperature which is directly proportional to pressure) result in actuation of the switch and consequently the compressor.

One of the shortcomings or weaknesses of a refrigeration system of the type discribed hereinabove is the frequency of failure of the system because of a failure of the capillary tube. Generally, this tube is made from 1/16 inch copper tubing connected at one end to the compressor and at the other end to the pressure switch control unit. Frequently, this tube breaks, either as a consequence of mechanical fatigue or as a consequence of a serviceman or other personnel accidentally bumping it. Breakage of this tube involves not only replacement of the tube but much more seriously, replacement of the complete charge of refrigerant plus in some instances, loss of refrigerated food products. In many larger installations, replacement of the refrigerant alone involves an expenditure of hundreds or even thousands of dollars.

One system that has alleviated the above described consequences of failure of the capillary tube of the control unit is outlined in U.S. Pat. No. 3,498,075. In the control unit disclosed therein, the pressure actuated switch is physically isolated from the flow control path of the refrigerant so that failure of the control unit or of the interconnection between the refrigerant and the pressure switch has no effect upon and does not result in the loss of the refrigerant. This isolation is provided by pressure actuated diaphragm motors or bellows located at opposite ends of a non-compressible capillary tube and interconnected by a pressure transmitting fluid enclosed within the tube. While this system serves admirably in overcoming the disadvantages noted above in control units in which the pressure actuated switch is connected directly to the refrigerant line, the system involves monitoring pressure changes in the refrigerant line by the pressure actuated switch in an indirect manner by means of an arrangement involving a secondary sensing device and a transmitting fluid, rather than directly by the pressure actuated switch as in the system it is intended to replace.

SUMMARY OF THE INVENTION

It is an object of this invention, therefore, to provide a refrigeration system that is not subject to the disadvantages and the shortcomings of the refrigeration systems outlined above. It is a particular object of this invention to provide a refrigeration system that avoids the severe consequences of failure of the capillary tube of the control unit of a refrigeration system while permitting, at the same time, direct sensing by the pressure actuated switch of the control unit of pressure changes in the refrigerant line of the system.

To this end, a refrigeration system is provided comprising a control unit, as heretofore, that utilizes a pressure actuated switch to control the compressor, the actuator of the switch being connected to the refrigerant line by a small capillary tube so that the switch can monitor pressure changes therein directly. Mounted between the pressure actuated switch and the refrigerant line is a bi-directional check valve which, under normal conditions, provides direct communication between the refrigerant line and the pressure actuated switch for direct sensing of pressure changes in the line by the switch, but which functions to seal off the refrigerant line in the event of an emergency, such as a failure of the capillary tube.

The check valve is bi-directional as opposed to a one-way check valve due to the fact that refrigeration systems can and do operate in a vacuum which in the event of capillary line breakage would permit air and moisture to enter the refrigeration system. Air and moisture would contaminate the refrigeration system resulting in expensive evacuation of the system and/or replacement of compressor and components.

DESCRIPTION OF THE PREFERRED EMBODIMENT

Generally, the invention of this application is illustrated as applied to a conventional vapor compression cycle refrigeration or air conditioning system. It should be appreciated, however, that the control unit of this system is equally applicable to other types of refrigeration systems. Therefore, the term "refrigeration" is used generically throughout this application to designate any type of cooling, refrigerating, or air conditioning system.

Figure 1:
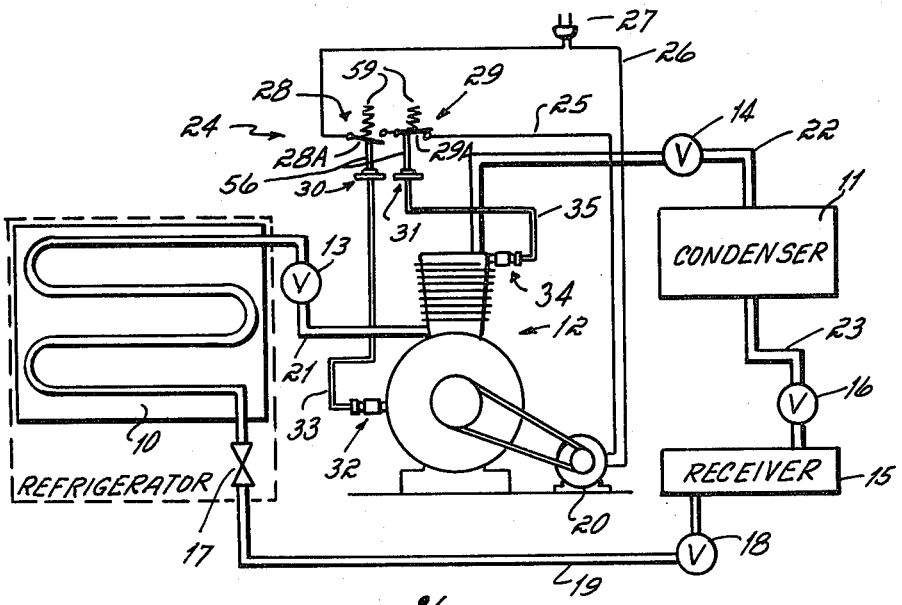
FIG. 1 is a diagrammatic illustration of a typical refrigerant or air conditioning system incorporating the control unit of this invention.

The vapor compression cycle refrigeration system illustrated in FIG. 1 is a typical commercially available refrigeration system except for the novel control portion of the system. Basically, it comprises an evaporator 10, a compressor 12, a condenser 11, a receiver 15, and an expansion valve 17. Liquid refrigerant boils at a low temperature in the evaporator 10 to produce cooling. From the evaporator, the gaseous refrigerant is supplied through a conduit 21 via an inlet valve 13 to the compressor 12 which raises the temperature and pressure of the refrigerant. The gaseous pressurized refrigerant is then fed through a conduit 22 and an outlet valve 14 to the condenser 11 in which heat is withdrawn from the refrigerant. From the condenser, the refrigerant passes as a liquid through a conduit 23 and valve 16 to the receiver 15 where it is stored. From the receiver, the liquid refrigerant passes through an outlet or king valve 18 and conduit 19 through the expansion valve 17 back to the evaporator. In passing through the expansion valve 17, the liquid refrigerant expands and changes from the high pressure level in the condenser to the low pressure level in the evaporator 10. This flow cycle continues so long as a motor 20 continues to drive the compressor 12.

The control unit 24 which supplies power to the motor and thus controls its operation includes a pair of lead wires 25,26 which interconnect the motor to an electrical power source 27 through a pair of series connected switches 28,29. One of these switches 29 is spring biased to a normally closed position. Both switches 28,29 are pressure actuated by diaphragm piston actuators or motors 30,31. One switch 28 serves as a control switch to cycle the compressor while the other 29 serves as a high pressure safety switch to shut off the compressor in the event that pressure in the system exceeds a predetermined safe value, as is explained more fully hereinafter.

The control unit 24 has only been illustrated diagrammatically since, except for the interconnection or interface between the elctrical portion of the unit and the refrigerant flow path, it is a conventional "off the shelf" item of hardware which may be purchased from any of several sources. One such suitable control unit is manufactured by the Milford Division of the Robertshaw Controls Company and is designated as their Model No. PT 22-7401.

The pressure actuator 30 of switch 28 is connected to bi-functional valve 32 via a capillary tube 33, and similarly the diaphragm motor 31 is interconnected to bi-functional valve 34 via a capillary tube 35. Both bi-functional valves 32,34 are connected directly to the compressor 12, valve 32 being connected to the low pressure side of the compressor and valve 34 being connected to the high pressure side. Thus, the diaphragm motor 30 is operable to sense or respond directly to changes of pressure on the low pressure side of the compressor and the refrigerant system and the diaphragm motor 34 senses or responds directly to changes of pressure on the high pressure side of the compressor and the refrigerant network.

The pressure actuator 30, bi-directional valve 32, and transmitting capillary tube 33 are identical to the actuator 31, bi-directional valve 34, and transmitting capillary tube 35 so that only actuator 30, valve 32, and interconnecting tube 33 have been illustrated in detail. It should be appreciated, however, that an identical arrangement is located on the high pressure side of the compressor The diaphragm motor or pressure actuator 30 comprises a pair of discs 40, 41 brazed together at their peripheral edge so as to define a sealed central cavity 43 therebetween. A circular diaphragm spring 45 is sandwiched between and sealingly separates the two chambers 46,47 on opposite sides of the spring 45. This spring 45 is operative to bias a piston 48 of the motor against the inner surface 49 of the plate 41. Sleeves 50,51 are brazed or welded to opposite sides of the discs 40,41 and are provided with axial apertures 52,53 co-axial with central aperture 54, 55 in the discs 40,41 respectively. The aperture 52 in the sleeve 50 sealingly receives and is welded or brazed to one end 33A of the copper capillary tube 33. Sleeve 51 slidingly supports a piston rod 56, one end 57 of which bears against the disc 48 and the opposite end of which contacts the blade 28A of switch 28. A heavy spring 59 biases the switch 28 to a normally opened position against the bias of the diaphragm spring 45. Generally, an adjustment screw (not shown) is provided to adjust the compression of the spring 59 and thus the pressure required to close the switch 28.

Figure 2:
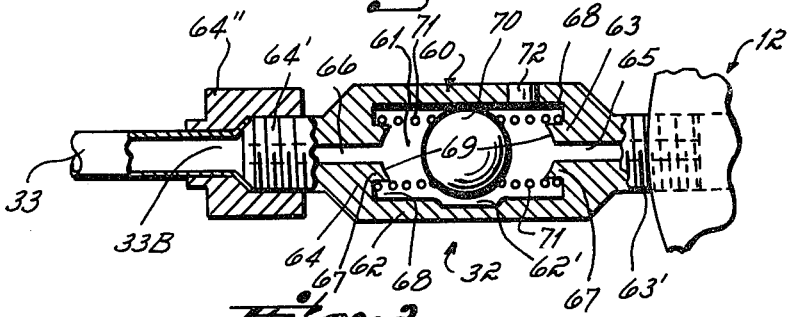
FIG. 2 is a side sectional view of the bi-directional valve incorporated in the control unit of this invention.
Figure 3:
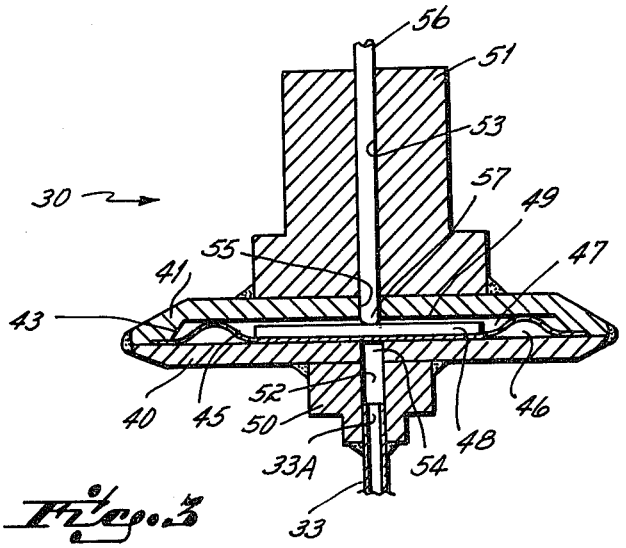
FIG. 3 is a side sectional view of the pressure actuated switch incorporated in the control unit of this invention.

Bi-directional valve 32 is shown in FIG. 2 and comprises valve body 60 having a cylindrical valve chamber 61 formed by circumferential wall 62, which is interrupted by by-pass port 62', and having opposed end walls 63, 64. End wall 63 is provided with valve port 65 connecting chamber 61 with compressor 12, while end wall 64 is provided with a similar port 66 connecting valve chamber 61 with capillary tube 33. End 63' of valve 32 is preferably provided with standard male pipe threads for connection to compressor 12, while end 64' of valve 32 is preferably provided with flare type threads connecting into a conventional fitting 64" adapted to the end 33B of capillary tube 33. Ports 65, 66 are smaller in diameter than but coaxial with valve chamber 61. Each end wall of chamber 61 is provided with an annular shoulder 67 surrounding ports 65, 66 and extending into chamber 61, the circumferential surface of shoulder 67 cooperating with chamber wall 62 to form an annular space 68 at either end of chamber 61. As shown in FIG. 2, the transverse surfaces of shoulders 67 provide frusto-conical valve seats 69 adapted to receive check ball 70. Also positioned within chamber 61 are coil springs 71, one end of each being seated against the surface of check ball 70, while the opposite ends thereof are seated in annular spaces 68 against the rear walls thereof. Illustrated for conveniency in bi-directional valve 32 of FIG. 2 is a press fitted pressure relief plug 72 which, in practice, will be found on the high pressure side of the system in bi-directional valve 34 of capillary tube 35. Pressure relief plug 72 is designed to be actuated and blown from the bi-directional valve 32 in the event of pressure build up in the refrigeration system beyond a preset safe value.

In operation of the control system, refrigerant pressure variations in the refrigeration system are transmitted directly to pressure actuated switch 30 through bi-directional valve 32 so long as capillary line 33 remains unbroken. Thus, assuming that the system has cut off and there occurs a refrigerant pressure increase in the evaporator on the low pressure side of the refrigerant system, this pressure variation will be transmitted through bi-directional valve 32 and capillary line 33 directly to pressure actuated switch 30 causing piston 48 and piston rod 56 thereof to close switch 28. When switch 28 is closed, the electrical circuit to compressor motor 20 from power source 27 through series connected switches 28,29 is completed. In the event that capillary line 33 is broken interrupting the direct communication from the refrigerant line to pressure actuated switch 30, ball check 70 will immediately move to a closed position against a valve seat thereby avoiding loss of refrigerant from the system as would occur in the absence of the bi-directional check valve.

Switch 28 is the control switch which cycles the compressor by turning it on when the temperature (and pressure) of the refrigerant in the evaporator and the compressor exceeds a preset value and turning it off when the temperature reaches the desired value. The other switch 29 is a high pressure safety switch operative to open the motor circuit in the event that the pressure at the head of the compressor or on the high pressure side of the refrigerant system exceeds a preset safe value. This might occur in the event of failure of the condenser or of any component in the system. In this event, the actuator 34 senses the unsafe high pressure condition and transmits the high pressure increase through the fluid in the capillary tube 35 to the pressure actuator 31 to open the switch 29. Thus, the compressor is stopped until the pressure is relieved and the condition corrected.

While I have described only a single preferred embodiment of my invention, persons skilled in this art will appreciate changes and modifications which may be made without departing from the spirit of my invention. Therefore, I do not intend to be limited except by the scope of the following appended claims:

1. A refrigeration cooling system which comprises a motor driven compressor for increasing the pressure of a refrigerant material in said system; a condenser for removing heat to cool said pressurized refrigerant material after it exits from said compressor; an expansion valve; an evaporator through which said cooled pressurized refrigerant passes to extract heat from the area surrounding said evaporator before being returned to the inlet side of said compressor; and a control unit for controlling the operation of said compressor, said control unit comprising a pressure actuated switch to control operation of said compressor and a capillary tube connecting said switch with the flow path of said refrigerant, the improvement in combination therewith which comprises: a bi-directional check valve positioned between said pressure actuated switch and the flow path of said refrigerant, said valve permitting refrigerant pressure changes to be transmitted directly through said capillary tube to said pressure actuated switch so long as said capillary line remains unbroken, said check valve further functioning to seal off the flow path of said refrigerant in the event a break occurs in said tube.

2. The refrigeration cooling system of claim 1 in which said capillary tube connects said pressure actuated switch through said check valve to the low pressure side of the refrigerant flow path between the evaporator and the high pressure side of the compressor.

3. The refrigeration cooling system of claim 1 in which said capillary tube connects said pressure actuated switch through said check valve to the high pressure side of the refrigerant flow path between the low pressure side of the compressor and the condenser.

4. The refrigeration cooling system of claim 3 in which said check valve is provided with a pressure relief plug adapted to be actuated in the event of pressure build up beyond a preset value.

5. The refrigeration cooling system of claim 1 in which the bi-directional check valve comprises a valve chamber provided with a by-pass port and with ports in the ends of said chamber for connecting it with the refrigerant flow path at one end and the capillary tube at the other end; a ball check positioned in said chamber between the ends of two coiled springs, the other ends of said springs being seated against the ends of said chamber; and valve seats at the ends of said chamber for seating the ball check.

6. The refrigeration cooling system of claim 5 which further includes a press fitted pressure relief plug in the wall of said chamber.

* * * * *